US009856677B1

(12) United States Patent
Lin

(10) Patent No.: US 9,856,677 B1
(45) Date of Patent: Jan. 2, 2018

(54) CYLINDER LOCK ASSEMBLY

(71) Applicant: XIAMEN MAKE SECURITY TECHNOLOGY CO., LTD., Xiamen (CN)

(72) Inventor: Shaolian Lin, Xiamen (CN)

(73) Assignee: XIAMEN MAKE SECURITY TECHNOLOGY CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/613,287

(22) Filed: Jun. 5, 2017

(30) Foreign Application Priority Data

Dec. 15, 2016 (CN) ..... 2016 2 1380170 U

(51) Int. Cl.

| | |
|---|---|
| ***E05B 29/06*** | (2006.01) |
| ***E05B 29/00*** | (2006.01) |
| ***E05B 9/04*** | (2006.01) |
| *E05B 19/00* | (2006.01) |

(52) U.S. Cl.
CPC ..... *E05B 29/0033* (2013.01); *E05B 9/04* (2013.01); *E05B 29/0053* (2013.01); *E05B 19/0035* (2013.01); *E05B 19/0058* (2013.01); *E05B 29/0066* (2013.01)

(58) Field of Classification Search
CPC .... E05B 29/0033; E05B 9/04; E05B 29/0053; E05B 29/0066; E05B 19/14; E05B 19/0017; E05B 19/0035; E05B 19/0058
USPC ..... 70/359, 376, 377, 409, 417, 492, 495, 70/496
See application file for complete search history.

(56) References Cited

U.S. PATENT DOCUMENTS 2,059,129 A * 10/1936 Maxwell ..... E05B 15/1614 70/372
2,453,066 A * 11/1948 Gabrielsen ..... E05B 29/004 70/385
3,260,080 A * 7/1966 Wellekens ..... E05B 29/004 70/367
3,578,371 A * 5/1971 Keller ..... E05B 29/00 70/377
3,735,614 A * 5/1973 Keller-Volper ..... E05B 29/00 70/377
3,999,413 A * 12/1976 Raymond ..... E05B 29/004 70/377
4,750,342 A * 6/1988 Nakai ..... E05B 29/00 70/377

(Continued)

FOREIGN PATENT DOCUMENTS

DE 102013216205 A1 * 3/2014

*Primary Examiner* — Lloyd Gall
(74) *Attorney, Agent, or Firm* — Leong C. Lei

(57) ABSTRACT

A cylinder lock assembly includes a lock cylinder inserted into a cylindrical chamber of a lock housing, the lock cylinder being formed with plate mounting slots, a latch slot, and a main key slot; primary locking plates inserted in the respective plate mounting slots, each of the primary locking plates being formed with a secondary plate recess, a first key slot, and a first latch groove; secondary locking plates inserted in the respective secondary plate recesses, each of the secondary locking plates being formed with a second key slot and a second latch groove, springs being provided between the primary locking plates and the lock cylinder and between the secondary locking plates and the lock cylinder respectively; and a latch inserted into the latch slot, a latch return spring being provided between the latch and the lock cylinder.

4 Claims, 3 Drawing Sheets

(56) References Cited

U.S. PATENT DOCUMENTS 4,966,021 A * 10/1990 Boag ..... E05B 29/004 70/377
4,977,767 A * 12/1990 Prunbauer ..... E05B 27/0082 70/406
5,765,417 A * 6/1998 Bolton ..... E05B 17/04 70/379 R
5,826,451 A * 10/1998 Cook ..... E05B 29/00 70/358
6,308,543 B1 * 10/2001 Yoshizawa ..... B23C 3/35 70/406
7,360,382 B2 * 4/2008 Fernandez ..... E05B 29/00 70/350
7,484,392 B2 * 2/2009 Katagiri ..... E05B 19/046 70/337
8,826,707 B2 * 9/2014 Habecke ..... E05B 19/0017 70/357
9,422,744 B2 * 8/2016 Lin ..... E05B 19/0017
2003/0037582 A1 * 2/2003 Edwards, Jr. ..... E05B 9/086 70/495
2003/0154752 A1 * 8/2003 Price ..... E05B 15/1614 70/358
2006/0000251 A1 * 1/2006 Ceron ..... E05B 9/086 70/492
2006/0201216 A1 * 9/2006 Gil ..... E05B 9/086 70/492
2007/0074552 A1 * 4/2007 Katagiri ..... E05B 19/046 70/492
2008/0178647 A1 * 7/2008 Calor ..... E05B 29/00 70/237
2009/0025442 A1 * 1/2009 Klein ..... E05B 19/0029 70/492
2009/0188286 A1 * 7/2009 Farrenkothen ..... E05B 29/00 70/351
2010/0300164 A1 * 12/2010 Yang ..... E05B 17/0004 70/377
2011/0314880 A1 * 12/2011 Sabata ..... E05B 29/00 70/492
2013/0152648 A1 * 6/2013 Havemann ..... E05B 29/00 70/492
2014/0053621 A1 * 2/2014 Zuraski ..... E05B 29/0013 70/492

* cited by examiner

CYLINDER LOCK ASSEMBLY

BACKGROUND OF THE INVENTION

1. Field of the Invention

The present invention relates to a cylinder lock assembly, and more particularly, to a simplified cylinder lock assembly.

2. Description of the Prior Art

The working principle of a cylinder lock uses the variations in depth of bittings of a key to align the variations in height of the locking plates inside a lock cylinder to undo the lock.

An improved lock cylinder is a high security lock cylinder, which provides a better anti-burglar effect than a common lock cylinder. The improved lock cylinder is provided with an additional code and uses a side pin locking mechanism, that is, the tumbler is held at the side of the lock cylinder. This can prolong the time to undo the lock. However, this lock cylinder has a more complicated structure and the security should be further improved. Accordingly, the present invention intends to provide a dual faucet structure for improving the shortcomings mentioned above.

SUMMARY OF THE INVENTION

The primary object of the present invention is to provide a cylinder lock assembly which has a simple structure and high performance of security.

In order to achieve the aforesaid object, the cylinder lock assembly of the present invention comprises a lock housing, a lock cylinder, primary locking plates, secondary locking plates, a latch, and a key. The lock housing has a cylindrical chamber and a latch groove. The lock cylinder is inserted into the cylindrical chamber in a rotatable manner. The lock cylinder is formed with plate mounting slots, a latch slot, and a main key slot. The primary locking plates are inserted in the respective plate mounting slots. Each of the primary locking plates is formed with a secondary plate recess, a first key slot, and a first latch groove. The first key slot is provided with a first locking tooth. The secondary locking plates are inserted in the respective secondary plate recess of the primary locking plates. Each of the secondary locking plates is formed with a second key slot and a second latch groove. The second key slot is provided with a second locking tooth. Springs are provided between the primary locking plates and the lock cylinder and between the secondary locking plates and the lock cylinder, respectively. The latch is inserted into the latch slot. A latch return spring is provided between the latch and the lock cylinder. The key has an insert lever which is insertable into the main key slot, the first key slot, and the second key slot. The insert lever is formed with double-row inner bittings to mate with the first locking teeth of the primary locking plates and the second locking teeth of the secondary locking plates for rotating the secondary locking plates and the primary locking plates, enabling the first latch groove and the second latch groove to align with the latch slot.

Preferably, the lock cylinder is formed with spring holes beside the plate mounting slots. One side of each primary locking plate is provided with a first spring post. One side of each secondary locking plate is provided with a second spring post. The springs are mounted in the spring holes and lean against the first spring posts of the primary locking plates or the second spring posts of the secondary locking plates, respectively.

Preferably, the primary locking plates and the secondary locking plates have corresponding anti-pick grooves, respectively.

Preferably, the lock cylinder is formed with an anti-drill plate slot behind the main key slot. An anti-drill plate is inserted in the anti-drill plate slot. The anti-drill plate is formed with a third key slot.

Thereby, the present invention has fewer components and a simpler structure. One primary locking plate and one secondary locking plate constitute a set of locking plates. The positions of the primary locking plate and the secondary locking plate of each set are changeable, so the assembly is simpler. The primary locking plates and the secondary locking plates cannot be distinguished when seen from the appearance of the finished product, thereby preventing them from being unlocked. One primary locking plate and one secondary locking plate constitute a set of locking plates. In case the number of the locking plate sets is n, the primary locking plates and the secondary locking plates have in variations of relative positions of the primary locking plates and the secondary locking plates, and n sets of locking plates have 2n locking plates, the number of the variations of the key bittings is m2n. This lock can improve the security greatly.

DETAILED DESCRIPTION OF THE PREFERRED EMBODIMENTS

Embodiments of the present invention will now be described, by way of example only, with reference to the accompanying drawings.

Figure 1:
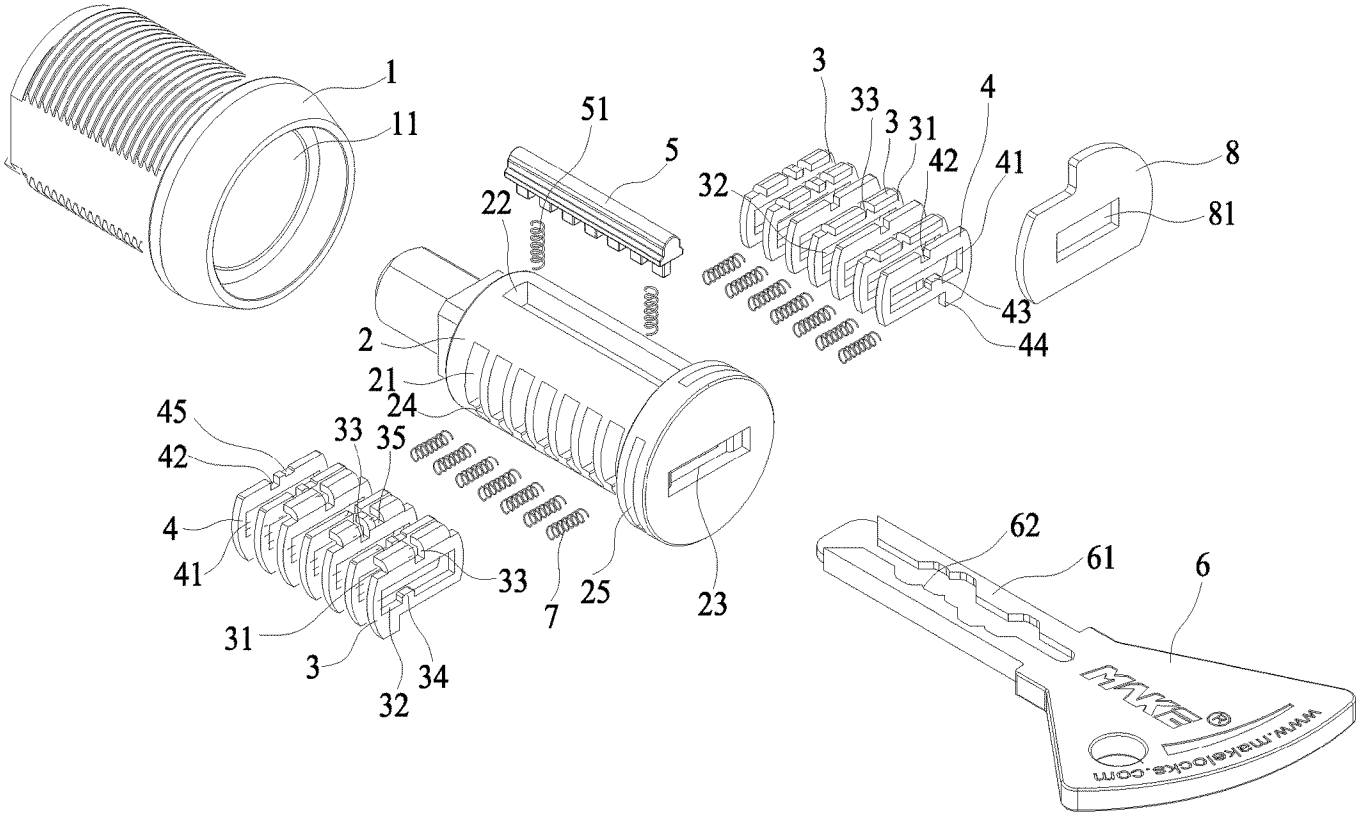
FIG. 1 is an exploded view of the present invention.
Figure 2:
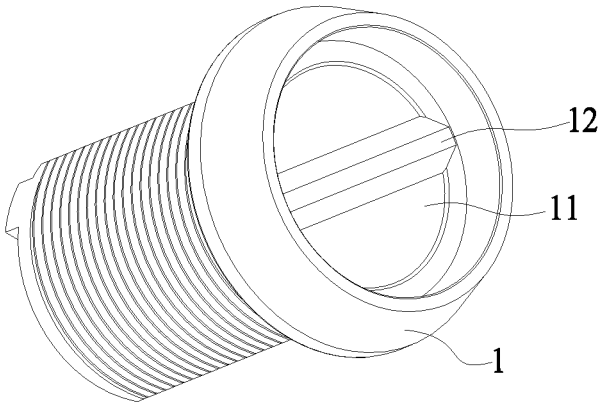
FIG. 2 is a perspective view of the lock housing of the present invention.
Figure 3:
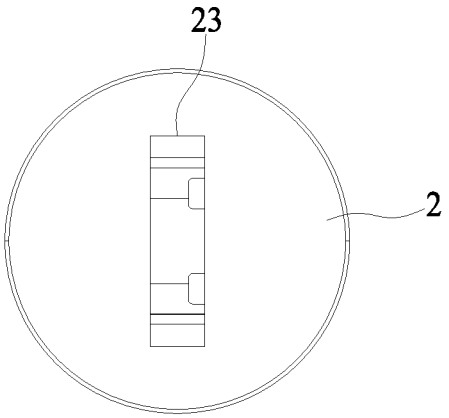
FIG. 3 is a front view of the lock cylinder having the primary and secondary locking plates of the present invention.
Figure 4:
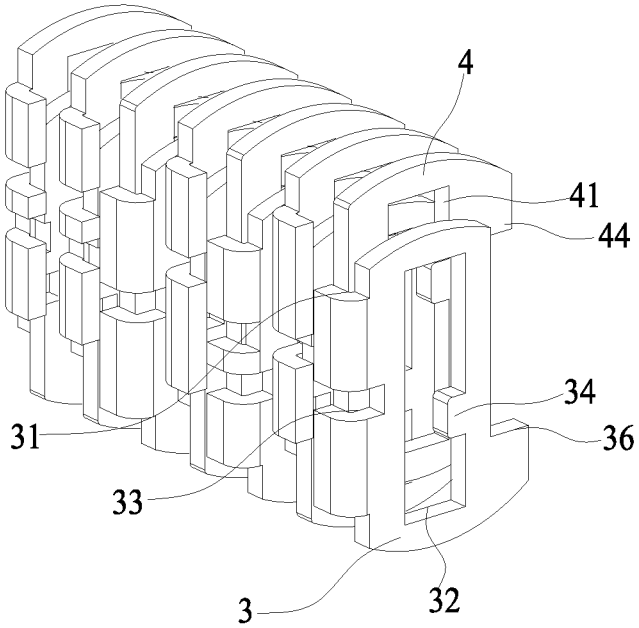
FIG. 4 is a perspective view of a combination of the primary and secondary locking plates of the present invention.
Figure 5:
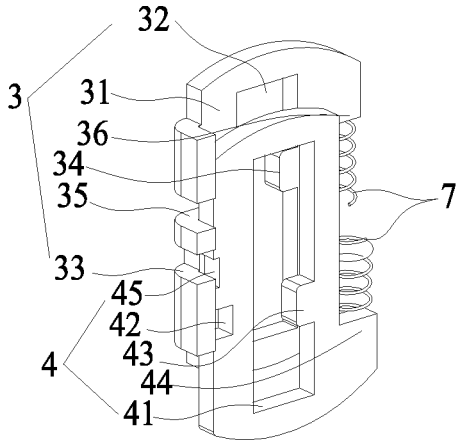
FIG. 5 is a perspective view of the primary locking plate, the secondary locking plate and the springs of the present invention.

As shown in FIG. 1 to FIG. 5, the present invention discloses a cylinder lock assembly. The cylinder lock assembly comprises a lock housing 1, a lock cylinder 2, primary locking plates 3, secondary locking plates 4, a latch 5 and a key 6.

The lock housing 1 has a cylindrical chamber 11 and a latch groove 12.

The lock cylinder 2 is inserted into the cylindrical chamber 11 in a rotatable manner. The lock cylinder 2 is formed with plate mounting slots 21, a latch slot 22, and a main key slot 23.

The primary locking plates 3 are inserted in the respective plate mounting slots 21. Each primary locking plate 3 is formed with a secondary plate recess 31, a first key slot 32, and a first latch groove 33. The first key slot 32 is provided with a first locking tooth 34. The secondary locking plates 4 are inserted in the secondary plate recesses 31 of the primary locking plates 3. Each secondary locking plate 4 is formed with a second key slot 41 and a second latch groove 42. The second key slot 41 is provided with a second locking tooth 43. Springs 7 are provided between the primary locking plates 3 and the lock cylinder 2 and between the secondary locking plates 4 and the lock cylinder 2, respectively. For ease of mounting, the lock cylinder 2 is formed with spring holes 24 beside the plate mounting slots 21. One side of each primary locking plate 3 is provided with a first spring post 36. One side of each secondary locking plate 4 is provided with a second spring post 44. The springs 7 are mounted in the spring holes 24 and lean against the first spring posts 36 of the primary locking plates 3 or the second spring posts 44 of the secondary locking plates 4, respectively.

The latch 5 is inserted into the latch slot 22. A latch return spring 51 is provided between the latch 5 and the lock cylinder 2.

The key 6 has an insert lever 61 which is insertable into the main key slot 23, the first key slot 32, and the second key slot 41. The insert lever 61 is formed with double-row inner bittings 62. The key double-row inner bittings 62 are mated with the first locking teeth 34 of the primary locking plates 3 and the second locking teeth 43 of the secondary locking plates 4 thereby causing the secondary locking plates 4 and the primary locking plates 3 to slide in the mounting slots 21 and therefore, enabling the first latch groove 33 and the second latch groove 42 to align with the latch slot 22 so as to undo the lock.

When the cylinder lock assembly of the present invention is in a locked state or the key is incorrect, the first latch grooves 33 of the primary locking plates 3 and the second latch grooves 42 of the secondary locking plates 4 are not aligned with the latch slot 22, and the latch 5 cannot enter the first latch grooves 33 and the second latch grooves 42 to be engaged in the latch groove 12 of the lock housing 1 so that the lock cylinder 2 cannot be rotated. When the correct key 6 is inserted, the double-row inner bittings 62 drive the secondary locking plates 4 and the primary locking plates 3 to slide in the mounting slots 21, followed by rotation of the key 6 in the lock cylinder 2, and compress the springs 7. The first latch grooves 33 of the primary locking plates 3 and the second latch grooves 42 of the secondary locking plates 4 are aligned with the latch slot 22, and then the key 6 is turned to rotate the lock cylinder 2 to push the latch 5 to compress the latch return spring 51 to disengage from the latch groove 12 and to enter the first latch grooves 33 and the second latch grooves 42 to disengage from the latch groove 12 of the lock housing 1, thereby allowing the key 6 to drive the lock cylinder 2 to rotate and unlock.

In order to further improve the performance of security, the primary locking plates 3 and the secondary locking plates 4 of the present invention have corresponding anti-pick grooves 35, 45, respectively. The lock cylinder 2 is formed with an anti-drill plate slot 25 behind the main key slot 23. An anti-drill plate 8 is inserted in the anti-drill plate slot 25. The anti-drill plate 8 is formed with a third key slot 81 for insertion of the insert lever 61 of the key 6. The anti-drill plate 8 is configured to prevent drilling and cutting.

The primary locking plates 3 and the secondary locking plates 4 of the present invention constitute a double-layer code which is extremely difficult to be unlocked and has high security. The primary locking plates 3 and the secondary locking plates 4 may be made of stainless steel with high strength, wear resistance and corrosion resistance. It is not easy to duplicate the key 6 having the double-row inner bittings 62. The number of the locking plate sets of the present invention determines the number of the variations of key bittings. For example, the number of the locking plate sets is seven. In case the primary locking plates 3 and the secondary locking plates 4 have four variations of relative positions of the primary locking plates 3 and the secondary locking plates 4 and seven sets of locking plates have fourteen locking plates, the number of the variations of the key bittings is 414, namely, 260 million. This lock can improve the security greatly.

Compared to the conventional cylinder lock assembly, the present invention has the following advantages:

(1) One primary locking plate 3 and one secondary locking plate 4 of the present invention constitute a whole set of locking plates, so the structure is simple. One primary locking plate and one secondary locking plate of the conventional cylinder lock assembly constitute a small set of locking plates and then two small sets of locking plates are assembled to form a whole set of locking plates, so the structure is complicated (2) The primary locking plates 3 and the secondary locking plates 4 of the present invention can be arranged in any direction up and down. The primary locking plates 3 and the secondary locking plates 4 cannot be distinguished when seen from the appearance of the finished product, thereby preventing them from being unlocked. The positions of the primary locking plates and the secondary locking plates of the conventional cylinder lock assembly are fixed, so the primary locking plates and the secondary locking plates can be distinguished with ease when seen from the appearance of the finished product.

(3) The key 6 of the present invention has the double-row inner bittings 62, so it is very difficult to duplicate the key. The key of the conventional cylinder lock assembly has four-row two-layer outer bittings, so it is easy to duplicate the key.

(4) The primary locking plates 3 and the secondary locking plates 4 of the present invention are formed by stamping, so the cost is low. The primary locking plates of the conventional cylinder lock assembly are formed by powder injection molding, so the cost is high.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A cylinder lock assembly, comprising a lock housing, a lock cylinder, primary locking plates, secondary locking plates, a latch, and a key;

the lock housing having a cylindrical chamber and a latch groove;

the lock cylinder being inserted into the cylindrical chamber in a rotatable manner, the lock cylinder being formed with plate mounting slots, a latch slot, and a main key slot;

the primary locking plates being inserted in the respective plate mounting slots, each of the primary locking plates having a flange extending from the primary locking plates to form a secondary recess, a first key slot, and a first latch groove, the first key slot being provided with a first locking tooth;

the secondary locking plates being each inserted in the respective secondary plate recess of the primary locking plates, each of the secondary locking plates being formed with a second key slot and a second latch groove, the second key slot being provided with a second locking tooth, springs being provided between the primary locking plates and the lock cylinder and between the secondary locking plates and the lock cylinder respectively;

the latch being inserted into the latch slot, a latch return spring being provided between the latch and the lock cylinder;

the key having an insert lever insertable into the main key slot, the first key slot, and the second key slot, the insert lever being formed with double-row inner bittings to mate with the first locking teeth of the primary locking plates and the second locking teeth of the secondary locking plates for sliding the secondary locking plates and the primary locking plates, enabling the first latch groove and the second latch groove to align with the latch slot.

2. The cylinder lock assembly as claimed in claim 1, wherein the lock cylinder is formed with spring holes beside the plate mounting slots, one side of each of the primary locking plates is provided with a first spring post, one side of each of the secondary locking plates is provided with a second spring post, and the springs are mounted in the spring holes and lean against the first spring posts of the primary locking plates or the second spring posts of the secondary locking plates, respectively.

3. The cylinder lock assembly as claimed in claim 1, wherein the primary locking plates and the secondary locking plates have corresponding anti-pick grooves, respectively.

4. The cylinder lock assembly as claimed in claim 1, wherein the lock cylinder is formed with an anti-drill plate slot behind the main key slot, an anti-drill plate is inserted in the anti-drill plate slot, and the anti-drill plate is formed with a third key slot.

* * * * *